United States Patent [19]

Mori

[11] 4,183,161

[45] Jan. 15, 1980

[54] INDEX DEVICE

[75] Inventor: Chuzo Mori, Tateishi, Japan

[73] Assignee: Carl Manufacturing Co., Ltd., Tokyo, Japan

[21] Appl. No.: 880,127

[22] Filed: Feb. 22, 1978

[51] Int. Cl.[2] ..... B42F 17/20; B42F 17/34

[52] U.S. Cl. ..... 40/389

[58] Field of Search ..... 40/581, 589, 389, 381

[56] References Cited

U.S. PATENT DOCUMENTS

| | | | |
|---|---|---|---|
| 2,849,815 | 9/1958 | Neilsen | 40/389 |
| 2,960,781 | 11/1960 | Olson | 40/389 |
| 3,073,049 | 1/1963 | Levesque | 40/389 |
| 4,064,643 | 12/1977 | Greif | 40/381 |

*Primary Examiner*—Louis G. Mancene

*Assistant Examiner*—Wenceslao J. Contreras

*Attorney, Agent, or Firm*—Brisebois & Kruger

[57] ABSTRACT

An indexing device for storing the information such as telephone numbers and addresses. When one of a plurality of push-buttons with index codes is pressed, some of the numerous cards internally housed are lifted and retained by the cover at the time the cover opens, to show a selected card. The cover has, internally on one side, a projection to engage one side of the card stack when the cover is closed and has on the other side, a card-grip to hold the cards lifted when the button is pressed. The projection supports one side of the cards when the cards are lifted, and it enlarges the lifting amount of the other side (the card-grip side) of the lifted cards.

11 Claims, 17 Drawing Figures

INDEX DEVICE

BACKGROUND OF THE INVENTION

The present invention relates to an indexing device for storing telephone numbers and other information for retrieval, the device being easy to handle, reliable in action and easy to manufacture.

In most of the conventional indexing devices, letters of an alphabet are carried on the cover extending over the cards; a guide slit is provided near the position of these letters; an operator which partly goes into the guide slit is movable in relation to the cover; a slider is integrally attached to the operator; and using the slider, the device can be opened to lift the cards to expose a card matching the position of the operator.

In such indexing devices, the operation is cumbersome with two steps required, i.e., setting the operator to a specific letter on the cover, and opening the cover by unlocking the cover from the base by pressing a button on the base.

An operator designed as a push-button mechanism in which the opening of the cover and the selection of a card can be done in one action is disclosed in the U.S. Pat. No. 3,073,049 (TELEPHONE INDEX), U.S. Pat. No. 2,960,781 (MULTIPLE CARD INDEX), U.S. Pat. No. 2,849,815, U.S. Pat. No. 2,329,300 (BOOK CONSTRUCTION), etc.; this operator has, however, the drawback that it is liable to pick up an unwanted card or cards together with the wanted one when the button is pressed. The U.S. Pat. No. 2,849,815 discloses a device which has a U-shaped piece to hold cards to the cover. However, since the U-shaped piece is spring-urged in one direction, many parts are needed to hold the card. Thus the device is complicated and in addition, the U-shaped piece has a middle part as wide as the front wall. Unwanted pickup frequently occurs when a selected card is lifted rapidly because of negative air pressure or suction between the lifted cards and the remaining cards of the stack. The present invention avoids this phenomenon.

SUMMARY OF THE INVENTION

The primary object of the present invention is to provide an indexing device which is free from the possibility of an adjoining card or cards being lifted together with a wanted card when the botton is pressed so that the indexing device will reliably open only to a wanted card.

Another object of the present invention is an indexing device which is compact with a few components and equipped on its cover with a structurally simple cardholder.

Another object of the present invention is to provide an indexing device which provides an enlarged space for housing the cards.

Another object of the present invention is to provide an indexing device which is easy to handle and manipulate.

Another object of the present invention is to provide an indexing device which is easy to manufacture and free from malfunction.

Another object of the present invention is to provide an indexing device in which a wanted card can be readily and reliably selected and picked up.

Still another object of the present invention is to provide an indexing device in which the cards can be readily exchanged.

These objects, and other features and advantages of the invention will become apparent from the following detailed description and the drawings.

BRIEF DESCRIPTION OF THE DRAWINGS

FIG. 12(*b*) is a view corresponding to FIG. 12(*a*) but showing the button pressed more than in FIG. 12(*a*) to release the cover lock;

FIG. 12(*c*) is a view corresponding to FIG. 12(*b*), but showing the cover just open to the position where the initially lifted cards are held by the card-grip;

DETAILED DESCRIPTION OF THE PREFERRED EMBODIMENT

Figure 1:
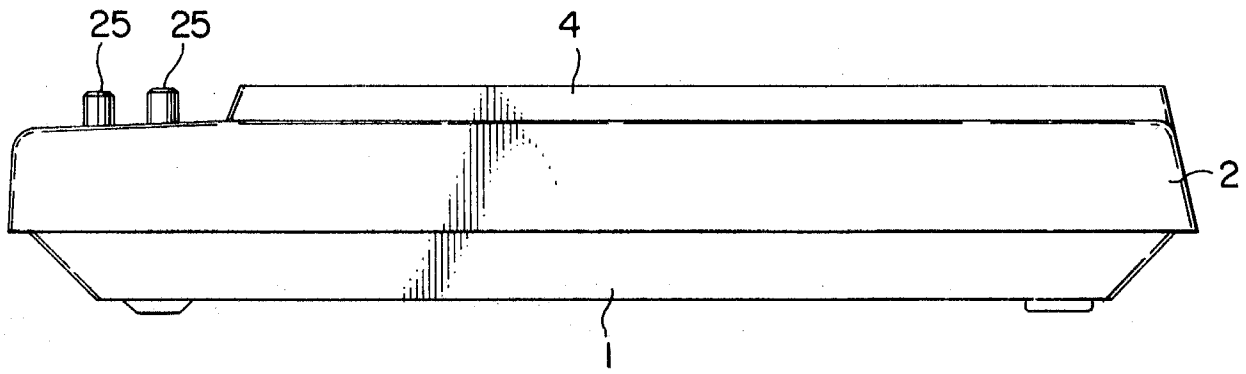
FIG. 1 is a side view showing the indexing device according to the present invention.
Figure 2:
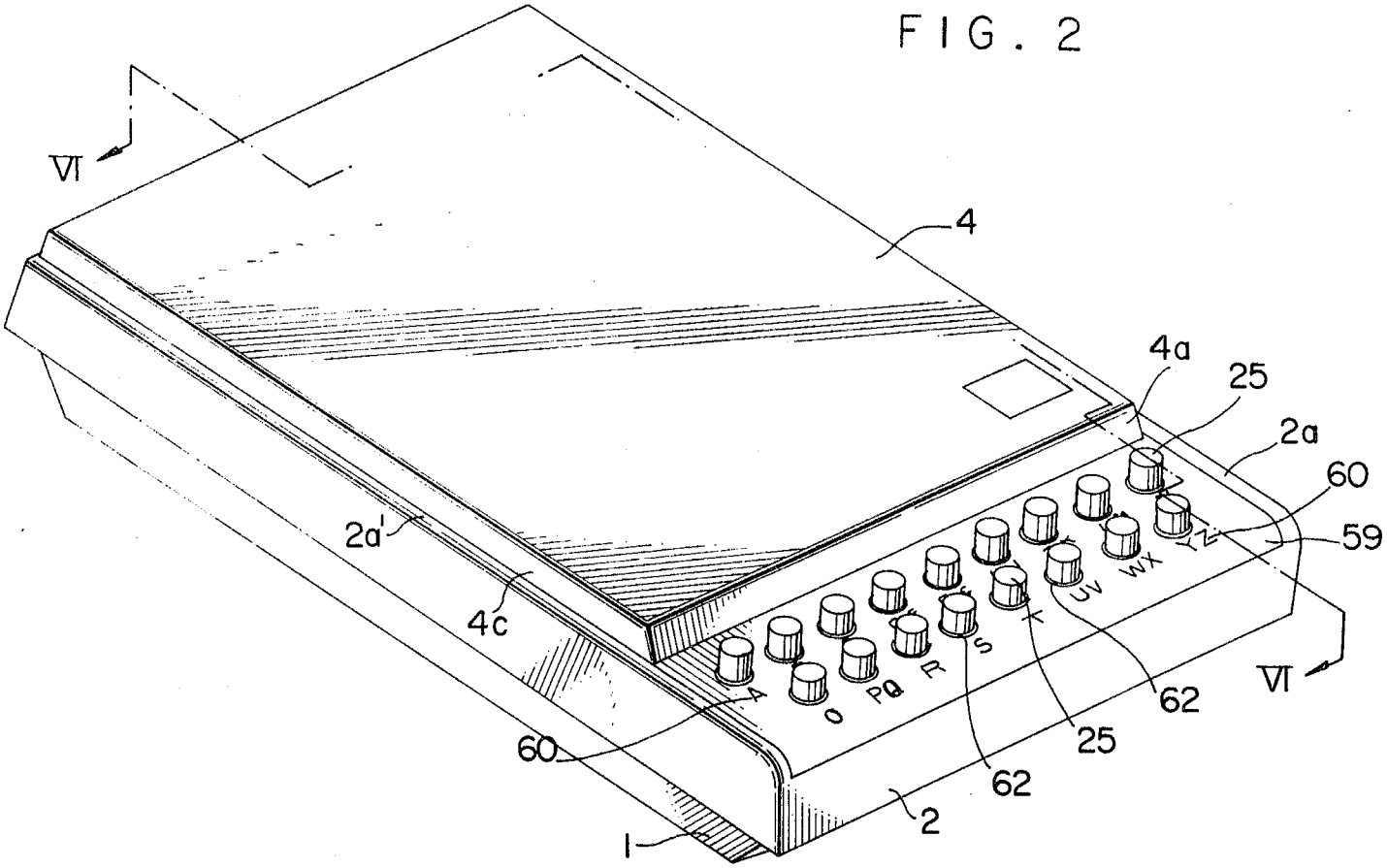
FIG. 2 is an oblique view of the indexing device.
Figure 3:
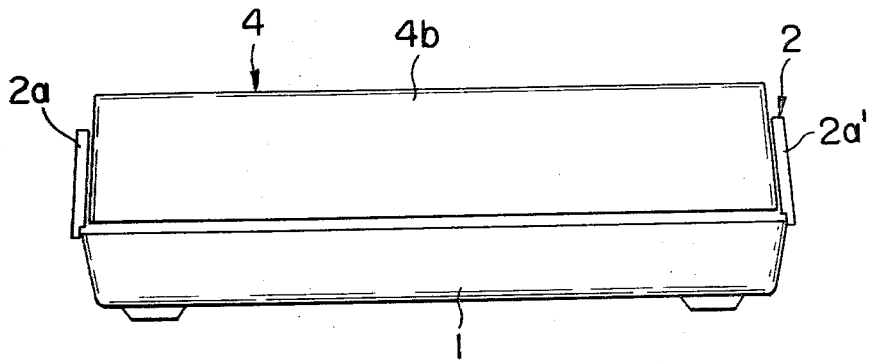
FIG. 3 is a right hand end view of the indexing device of FIG. 1.

Referring to the drawings, a preferred embodiment of the present invention will now be described.

Figure 4:
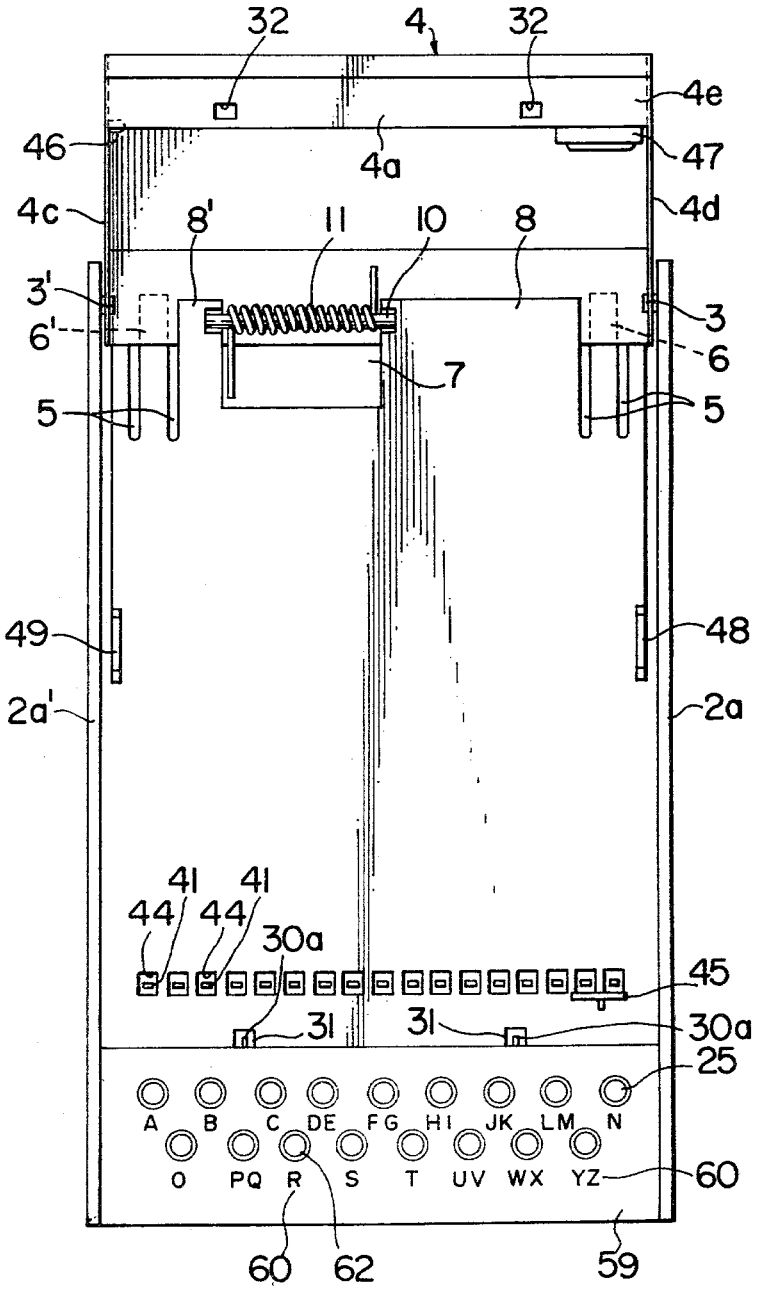
FIG. 4 is a plan view of the indexing device with the cover open.

FIGS. 1–6 show that the index device has a shallow open-top box-like base 1. A card-support body 2 is seated on the upper end of base 1, the body 2 having a front wall and side walls 2*a*,2*a*′ whose bottom edges seat on the upper edges of base 1. Projecting inwardly from the rearward ends of the side walls 2*a*,2*a*′ of the body 2 are axially aligned bosses or pins 3,3′ as shown at FIG. 4.

On body 2 is a box-like cover 4 with a front wall 4*a*, a rear wall 4*b* (FIG. 6) and side walls 4*c*, 4*d* (FIG. 4) and of such a size as to fit between the side walls 2*a*,2*a*′ of the body 2. The rearward ends of the side walls 4*c*, 4*d* of the cover 4 have aligned openings to receive bosses 3,3′ and the cover 4 can be opened and closed, pivoting around the bosses 3,3′.

The card-support body 2 (FIG. 6), has a horizontal plate portion which is inclined upward in the part from the center toward the rear. On both sides of the rearward end of this plate portion of body 2 are formed curved elastic cover-engaging fingers 6,6', separated from the plate by grooves 5,5. The fingers 6,6' are elastic enough to be deflected, when the cover 4 is opened, by the rear wall 4*b* of the cover 4, thereby causing sufficient friction to be developed between the fingers and the rear wall 4*b*, so that the cover 4 will open smoothly at an appropriate speed. At the rear end of the card-support body 2, between the fingers 6,6' and offset toward one side of body 2 is a recess 7 with its bottom inclined rearwardly.

Figure 5:
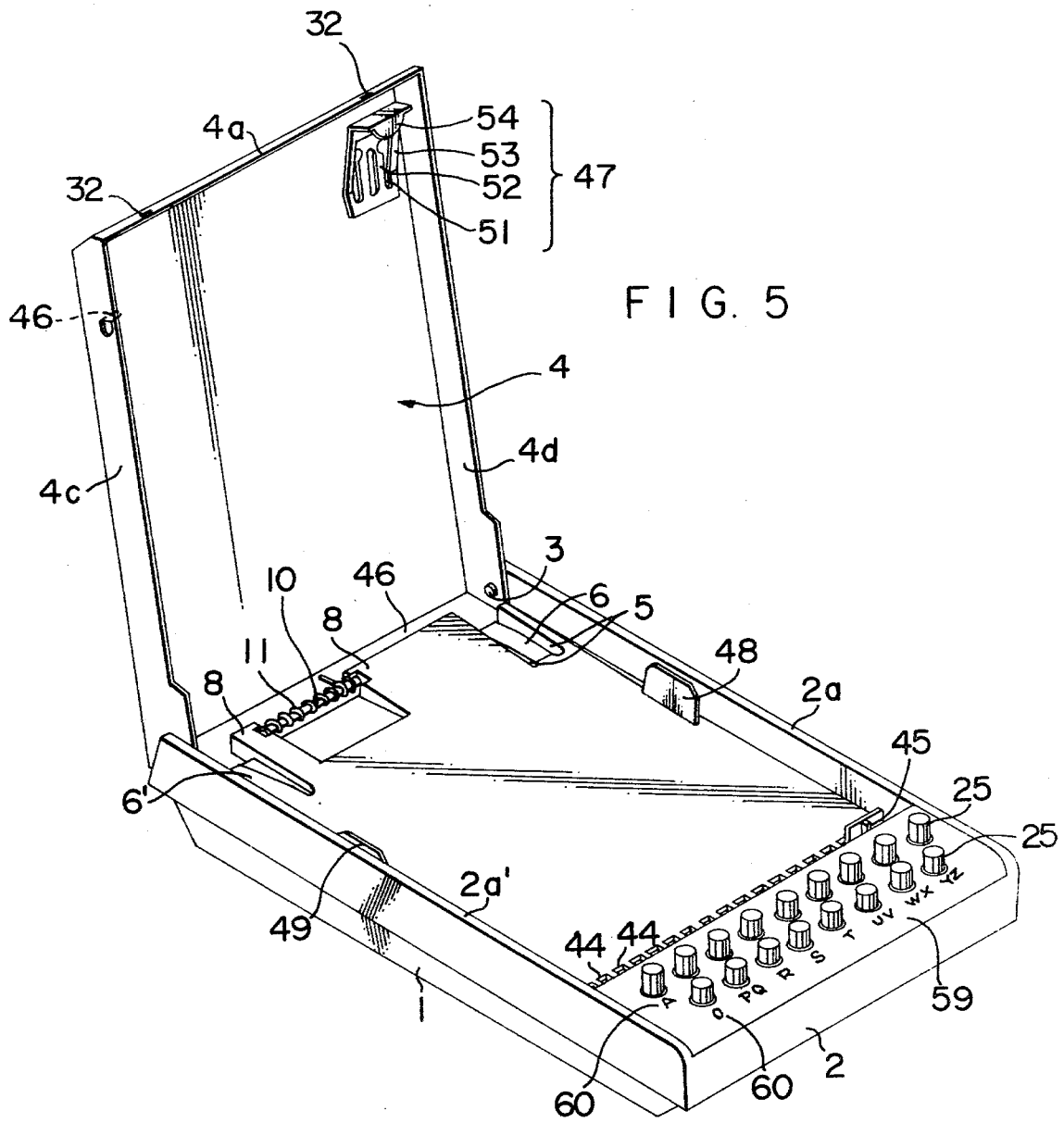
FIG. 5 is an oblique view of the indexing device with the cover open.
Figure 7:
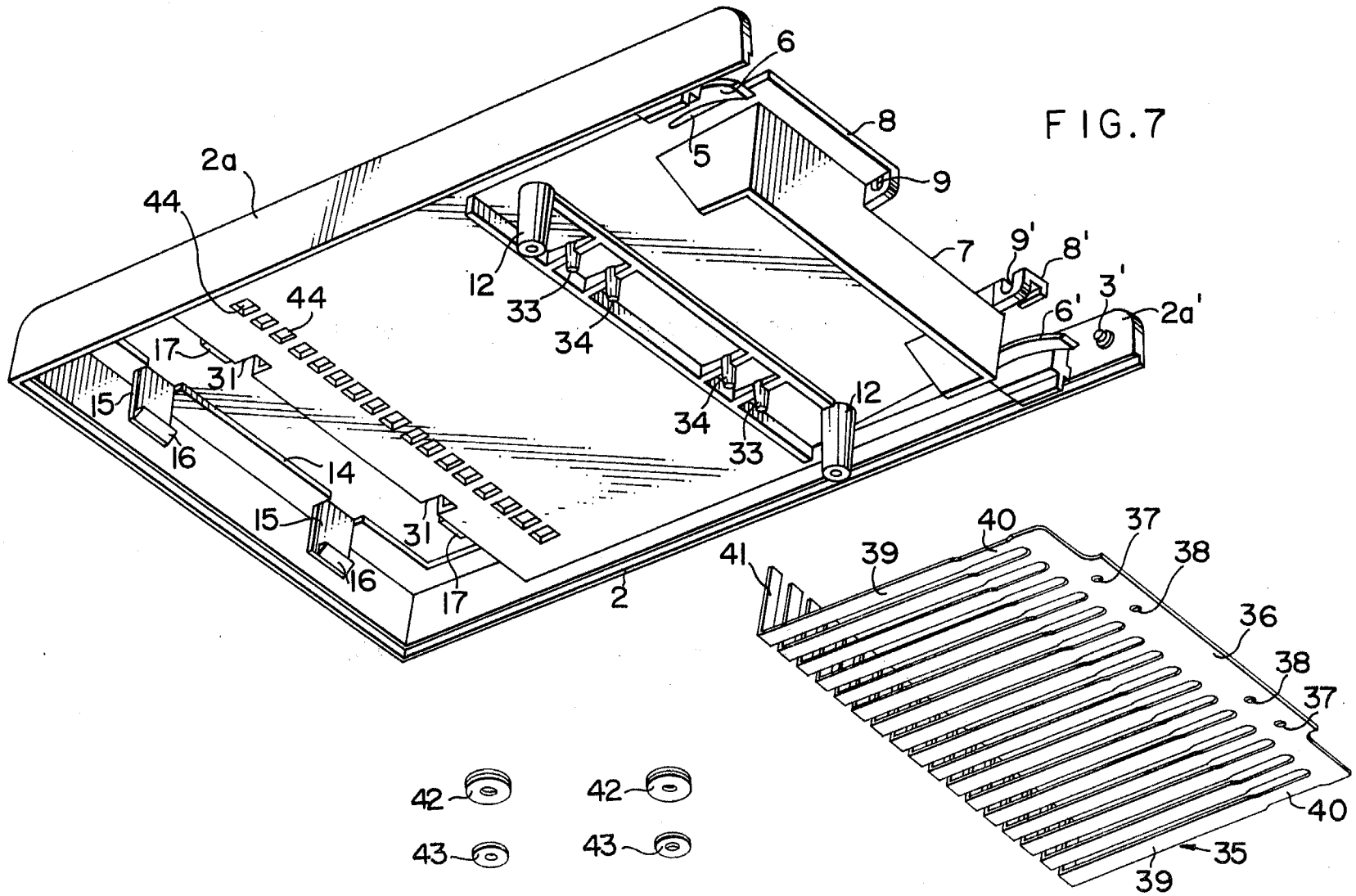
FIG. 7 is an exploded oblique bottom view of the card support body.

The projecting portions 8,8' of body 2 at each side of recess 7 have bores 9,9' as shown in FIG. 7, and extending through these bores 9,9', as shown in FIGS. 4 and 5 is a press fit rod 10. Around this rod 10 is wound a torsion spring 11. One end of the spring 11 presses against the inside surface of the rear wall 4*b* of the cover 4, while its other end presses against the bottom of the recess 7. Spring 11 constantly urges the cover 4 to open.

Figure 6:
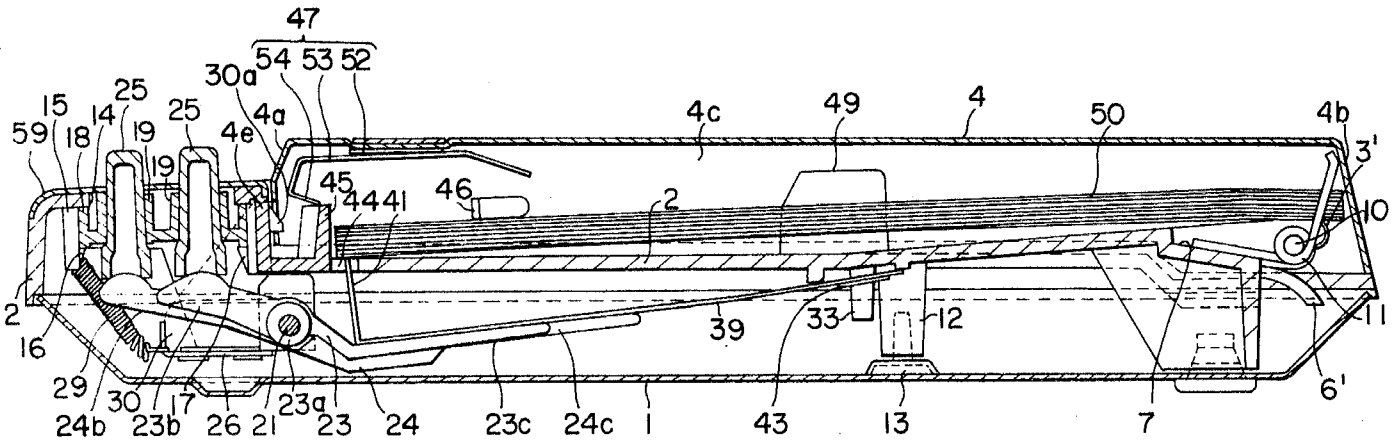
FIG. 6 is a view in section taken along line VI—VI in FIG. 2.
Figure 12A:
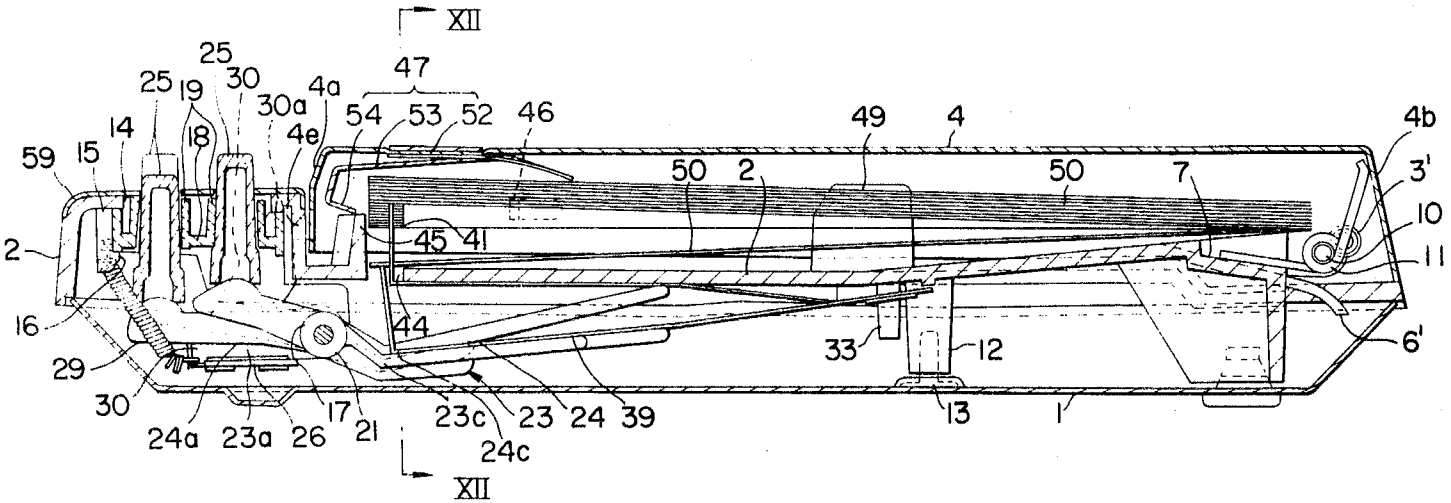
FIG. 12(*a*) is a view in longitudinal section showing the indexing device in the state with one push-button pressed to push up a card.
Figure 12B:
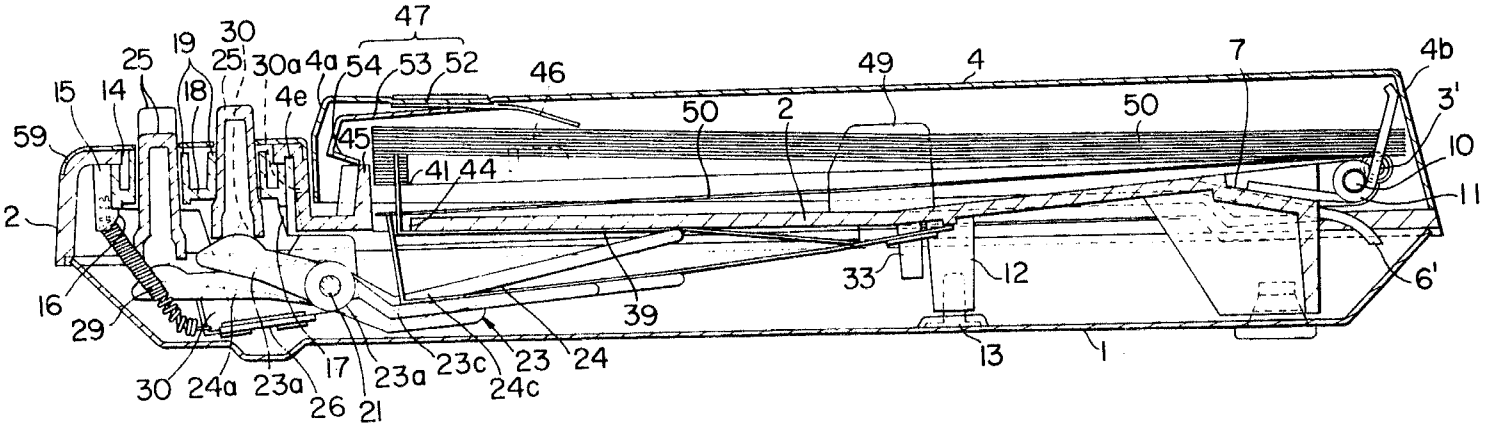
Figure 12C:
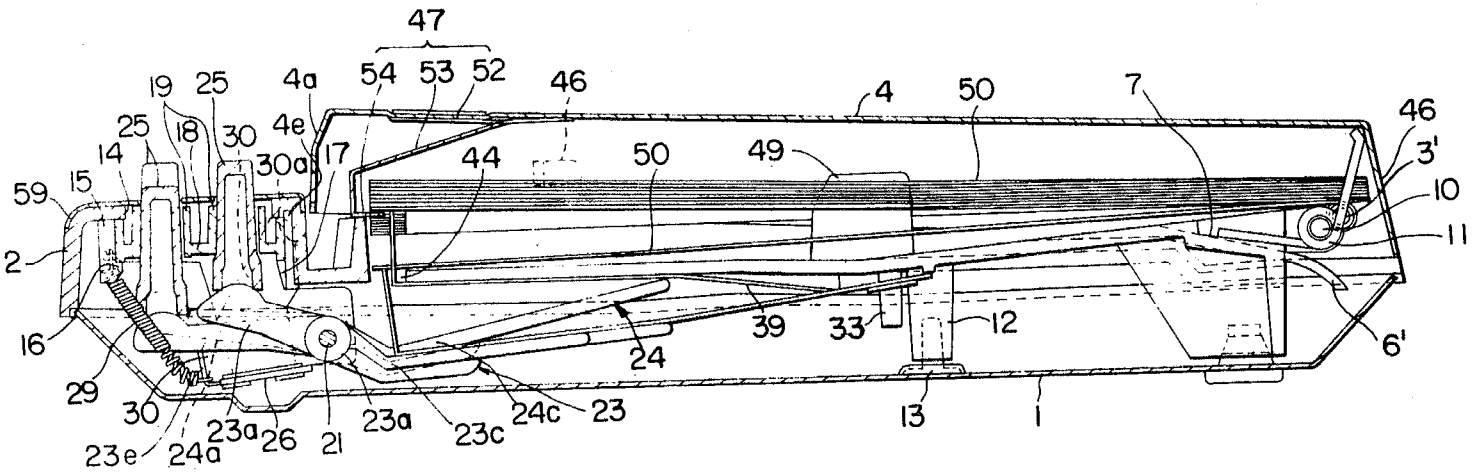
Figure 15:
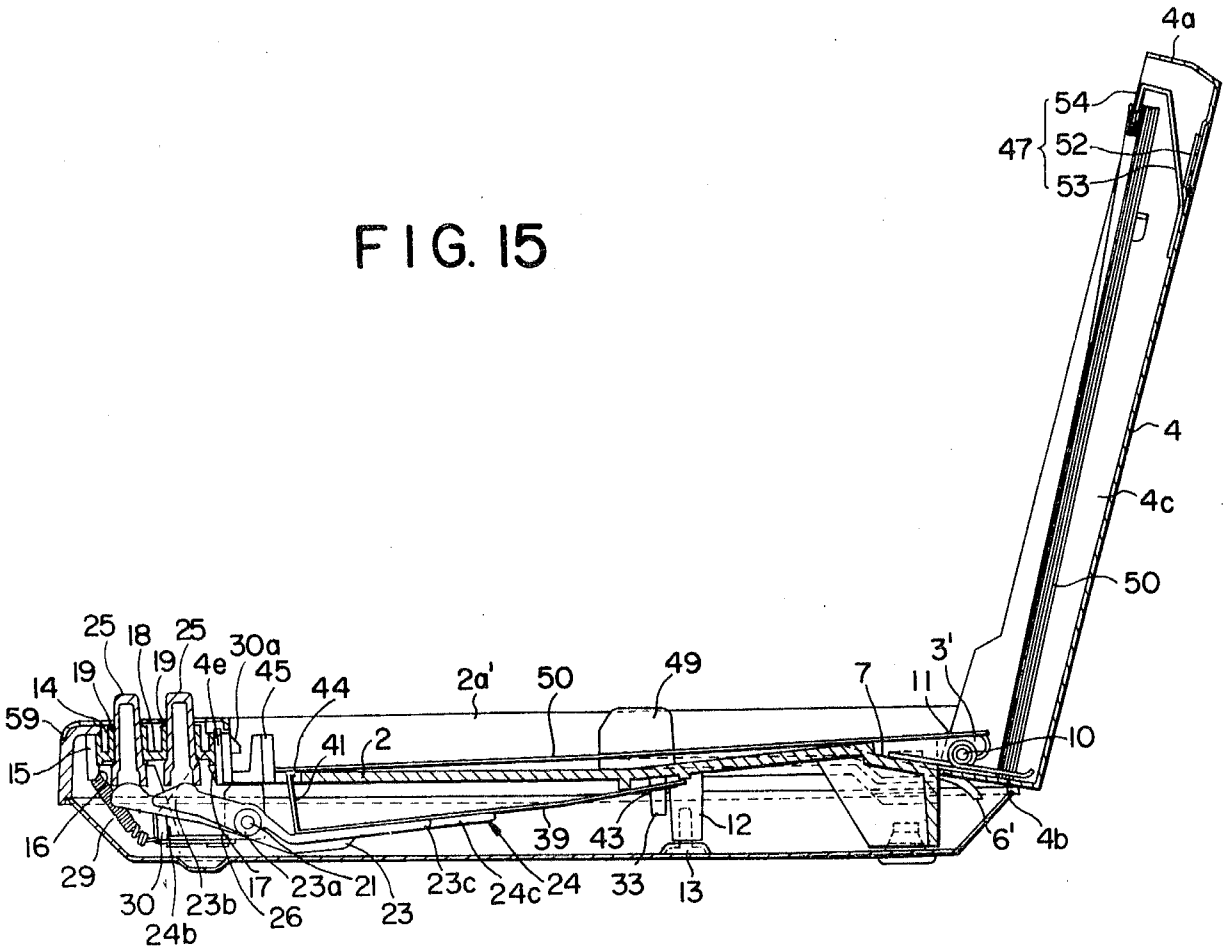
FIG. 15 is a partial view in longitudinal section of the open cover.

FIGS. 6, 12 and 15, show legs 12 integral with the card-support body 2, and which receive screws 13 for securing the body 2 to base 1.

At the front of the card-support body 2 there is a generally rectangular opening 14. At the forward edge of the opening 14 are pieces 15 which extend down and at the lower end of the pieces 15 are the projecting hooks 16,16; and on a partition wall 4*e* at the rearward edge of opening 14 are hooks 17 opposed to the hooks 16.

A push-button retaining member 18 fits into the opening 14. The button retaining member 18 is a snap-fit between the hooks 16, 17 and the top wall of the body 2, so that the member 18 is secured to the body.

The button retaining member 18 has a front and back row of vertical guide tubes 19,19 with plural tubes in each row. The openings in the tubes extend through member 18 (See FIG. 8) and the tubes are staggered. There is a bearing with an opening 20 at each rear side of member 18. A lever shaft 21 extends into the openings 20, and is held as indicated in FIG. 6, by circular clips 22 fitted into grooves 21*a* at both tips of the lever shaft, to prevent the lever shaft 21 from moving axially out of the openings 20.

Figure 8:
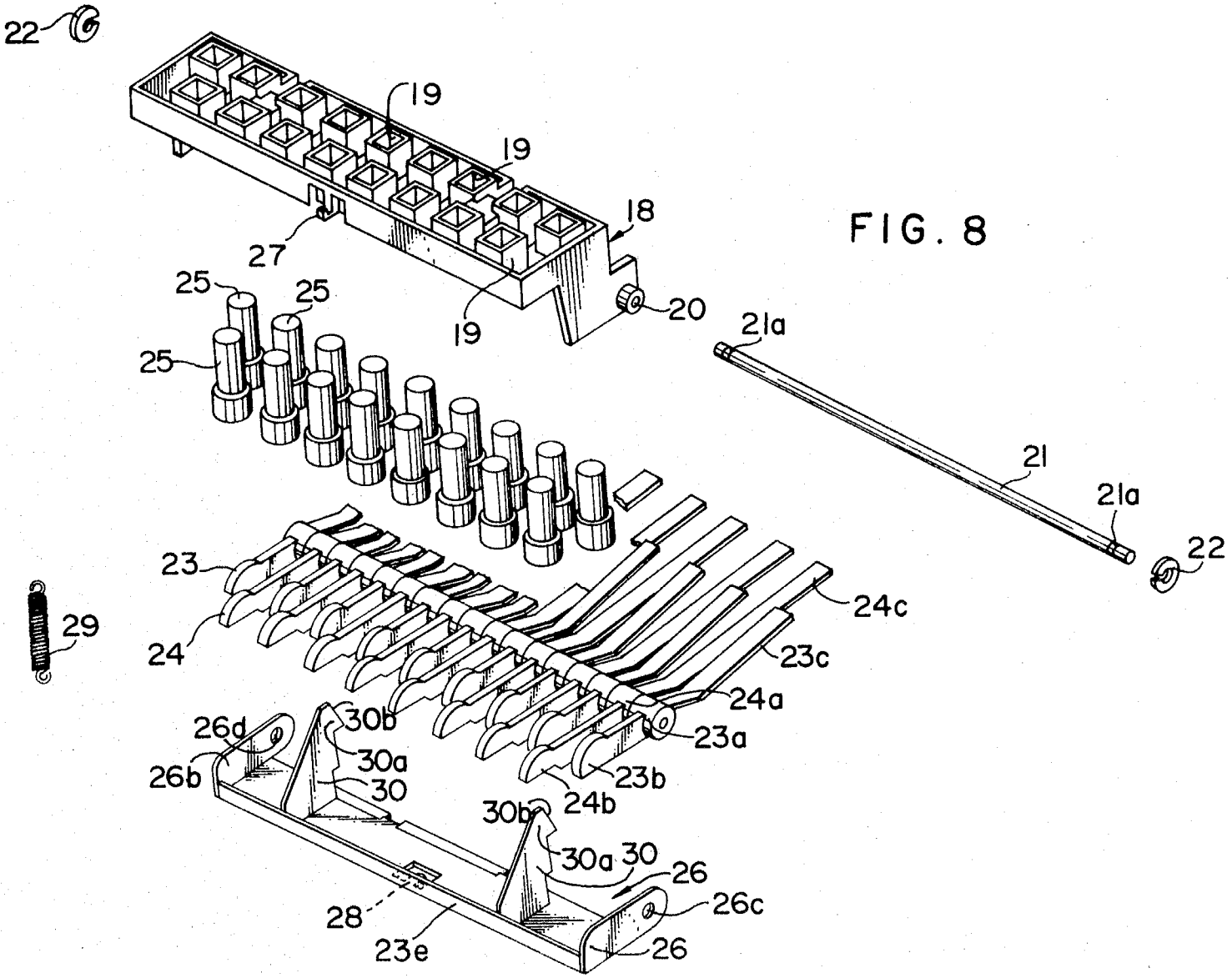
FIG. 8 is an exploded oblique view of the pushbutton and lever assembly at the front of the card support body.

FIG. 8 shows a first lever assembly comprised of levers 23 and 24. Each lever 23 has a rigid operating arm 23*b* secured to a bushing 23*a*, and an elastic operating plate 23*c*, also secured to the bushing and extending away from arm 23*b*. Each lever 24 has a rigid arm 24*b* secured to a bushing 24*a*, and an elastic operating plate 24*c*. Arms 23*b* are shorter than arms 24*b* and the levers 23 are alternated with the levers 24 on the lever shaft 21. The bushings 23*a*, 24*a*, are of a length to position the rounded end of each arm 24*b* beneath a different front row tube 19, and to position the rounded end of each arm 23*b* beneath a different rear row tube 19. Plates 23*c* are each shorter than the plates 24*c* and each plate is bent slightly upwardly.

FIGS. 6 and 8 show push-buttons 25, each with an increased diameter at the bottom end. The push-buttons respectively fit into the tubes 19, of the button retaining member 18. The bottom ends of the buttons 25, bear against the front tips of the operating arms 23*b*, 24*b* of the levers 23, 24.

A cover latch unit 26 is installed below the operating arms 23*b*, 24*b*, and extends parallel to the lever shaft 21. The unit 26, as shown in FIG. 8, has upright bent ends 26*a*, 26*b*, at one end of which are formed respectively the holes 26*c*, 26*d*, for pivotally mounting the latch unit 26 on the lever shaft 21 which extends into said holes 26*c*, 26*d*.

As shown at FIG. 8, a spring-engageable tab 27 is provided on the button retaining member 18, and a spring-engageable tab 28 is provided on the cover latch unit 26. Between these tabs 27, 28 there is stretched a helical spring 29 as indicated in FIG. 6, which urges latch unit 26 to turn clockwise. A pair of spaced apart cover latch arms 30 are fixed to latch unit 26, one at each side of the unit. Each arm 30 extends parallel to the ends 26*a*, 26*b* and has as its tip, a cover engaging hook 30*a*. Each hook 30*a* has an inclined nose 30*b*. Arms 30 are appropriately spaced apart to extend upwardly between selected adjacent arms 23*b*, 24*b*, and bear against the partition wall 4*e* of the card support body 2. The hooks 30*a*, extend respectively through the holes 31 of the partition wall 4*e* (FIGS. 4 and 7) and fit into the holes 32 (FIG. 5) formed in the front wall 4*a* of the cover 4, thereby maintaining the cover 4 closed. The inclined nose 30*b* pivots latch unit 26 counterclockwise in FIG. 6 as the cover 4 is closed.

From both sides of the bottom in the middle part of the card support body 2 project a pair of tapered rods 33, 34 (FIG. 7).

In FIG. 7, there is shown a second lever assembly 35, in the form of an elastic comb-like plate, having a base 36, the holes 37, 38 bored on both sides of base 36, and a plurality of lever elements 39,39 integral with the base 36. The narrow parts 40,40 formed at the bases of the lever elements 39,39 provide flexibility and the upward projections 41,41 are formed by bending the tips of levers 39,39 upwardly. The lever elements 39, of the second lever 35 are located (FIG. 6) above the first levers 23, 24 and base 36 is fixed to the card support body 2 by pressing the tapered rods 33, 34 into the holes 37, 38 and then applying the washers 42 and the circular clips 43 over the ends of the rods.

The upward projections 41 of lever elements 39 of the second lever assembly 35 project through numerous holes 44 (FIG. 4) formed near the front edge of the card support body 2.

FIG. 4 shows a hook engaging element 45 projecting from the right front edge of the card support body 2. A stop pin or boss 46 projects inwardly from the side wall 4*c* of the cover 4. A card-grip or holder 47 is attached on the other side of the inside of the front end of the cover. Projecting upwardly from both sides of the middle part of the card support body are card positioning elements 48 and 49.

The stop pin 46 comes to bear against the cards 50 on the card support body 2 when the cover 4 is closed. The card-grip 47 (FIG. 5) takes the form of an elastic plate in which a U-shaped groove 51 is cut to form a mounting piece 52, and a spring portion 53, the spring portion 53 being bent at the base to a specific angle with respect to the mounting piece 52. There is at the tip of spring portion 53, a U-shaped hook 54. Mounting piece 52 is secured to the cover 4 by hook-like tabs (not shown) provided in the cover 4.

Figure 9:
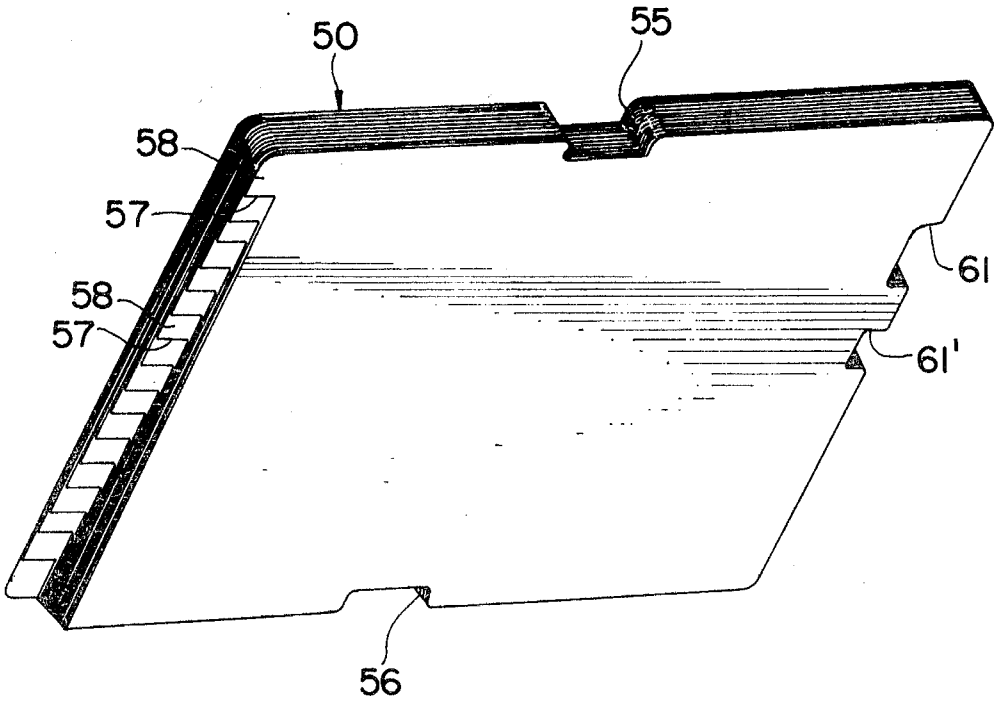
FIG. 9 is an oblique bottom view of a stack of cards used in the indexing device of the present invention.
Figure 10:
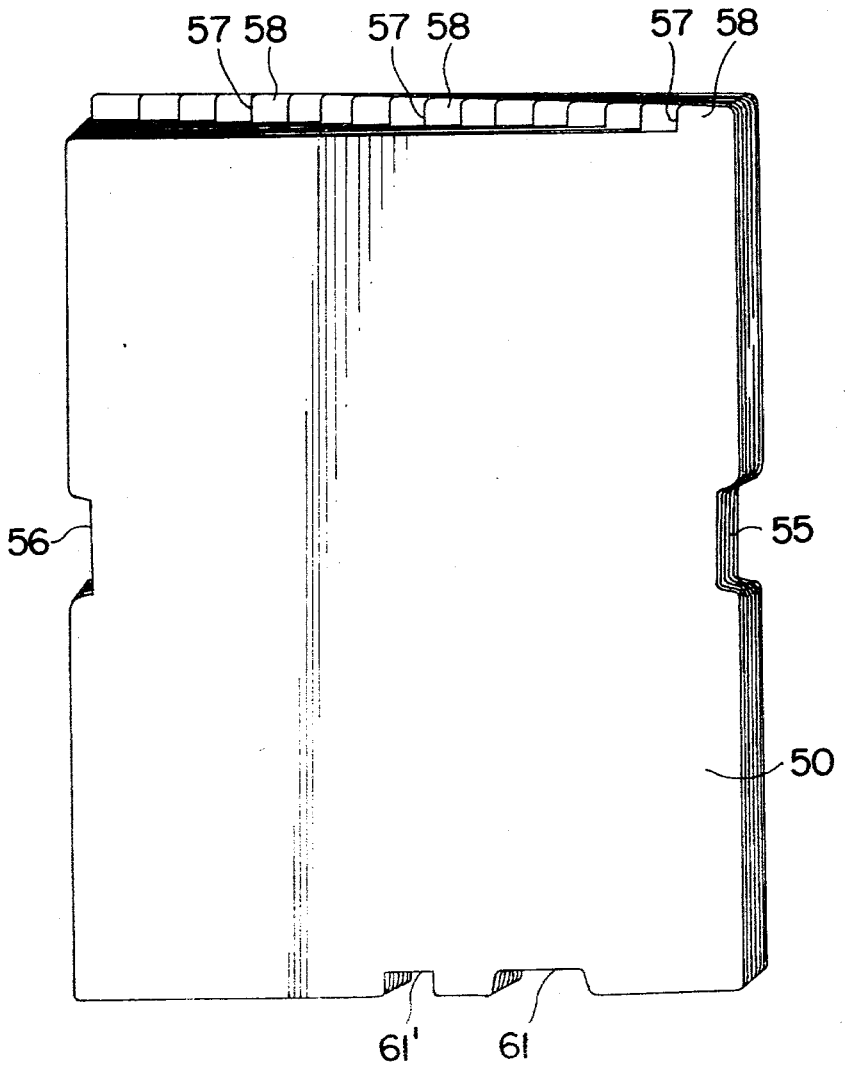
FIG. 10 is a bottom view of the card stack of FIG. 9.
Figure 14:
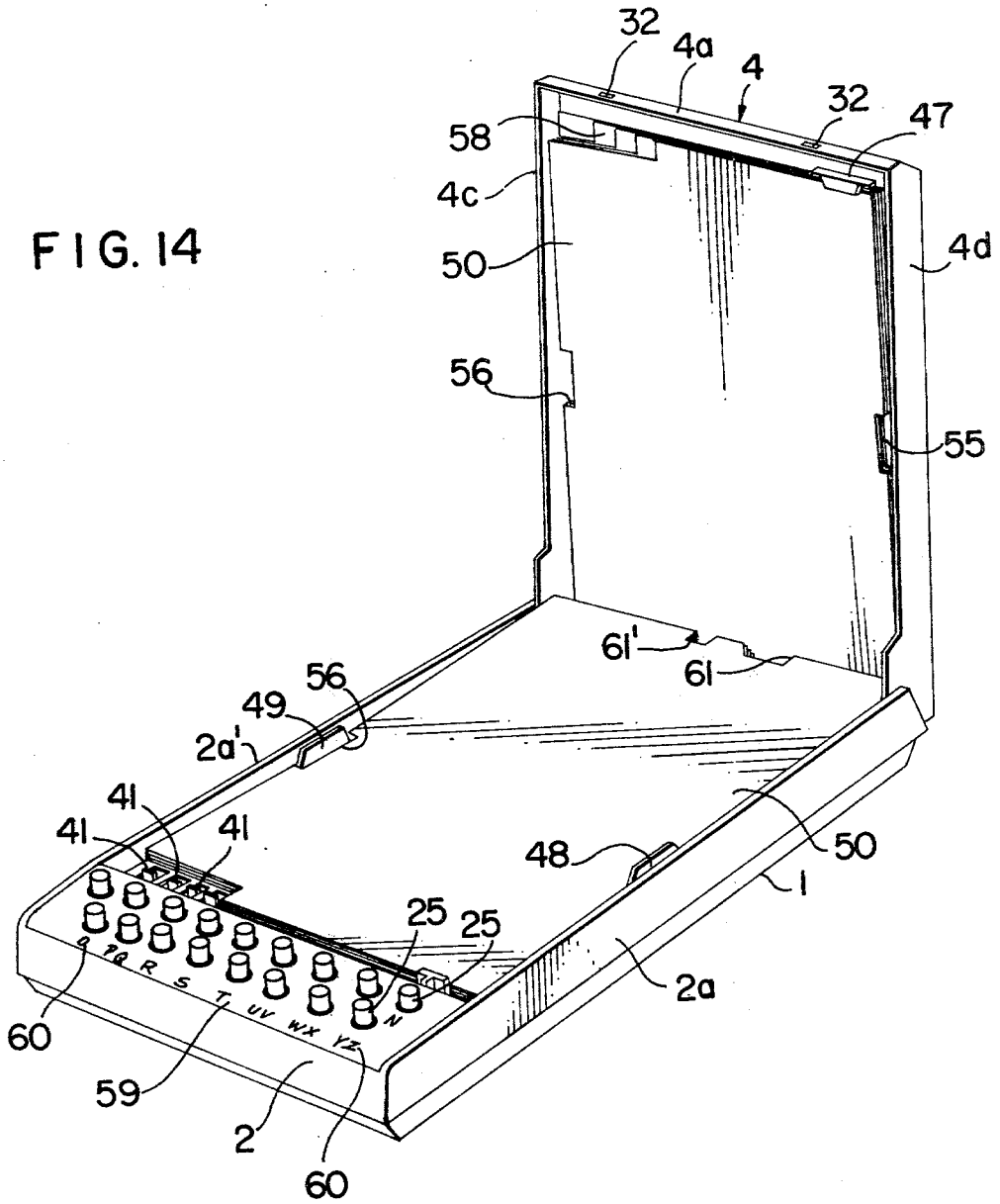
FIG. 14 is an oblique view of the indexing device with the cover open.

As shown in FIGS. 9 and 10, the cards 50 form a stack and have notches 55, 56 on both sides which engage the positioning pieces 48, 49, and ears 58 at the front edge which are formed by notches 57 staggered laterally by the same pitch. These cards are stacked in body 2 as illustrated in FIG. 14 with ears 58 facing downwardly toward the body to form a step-like array, the exposed portion of each ear being opposed to an upward projection 41 of the second lever assembly 35. Each card also has notches 61,61' provided at the rear of the card.

Extending over the push-button assembly and attached to the card support body 2 is a coverplate or nameplate. On the nameplate 59 are indexing letters, symbols, etc., 60 in front of the push-buttons 25. Formed in nameplate 59 are plural openings 62 aligned respectively with tubes 19 of the button retainer, and the upper portions of the push-buttons 25 extend through these openings.

OPERATION

Figure 11:
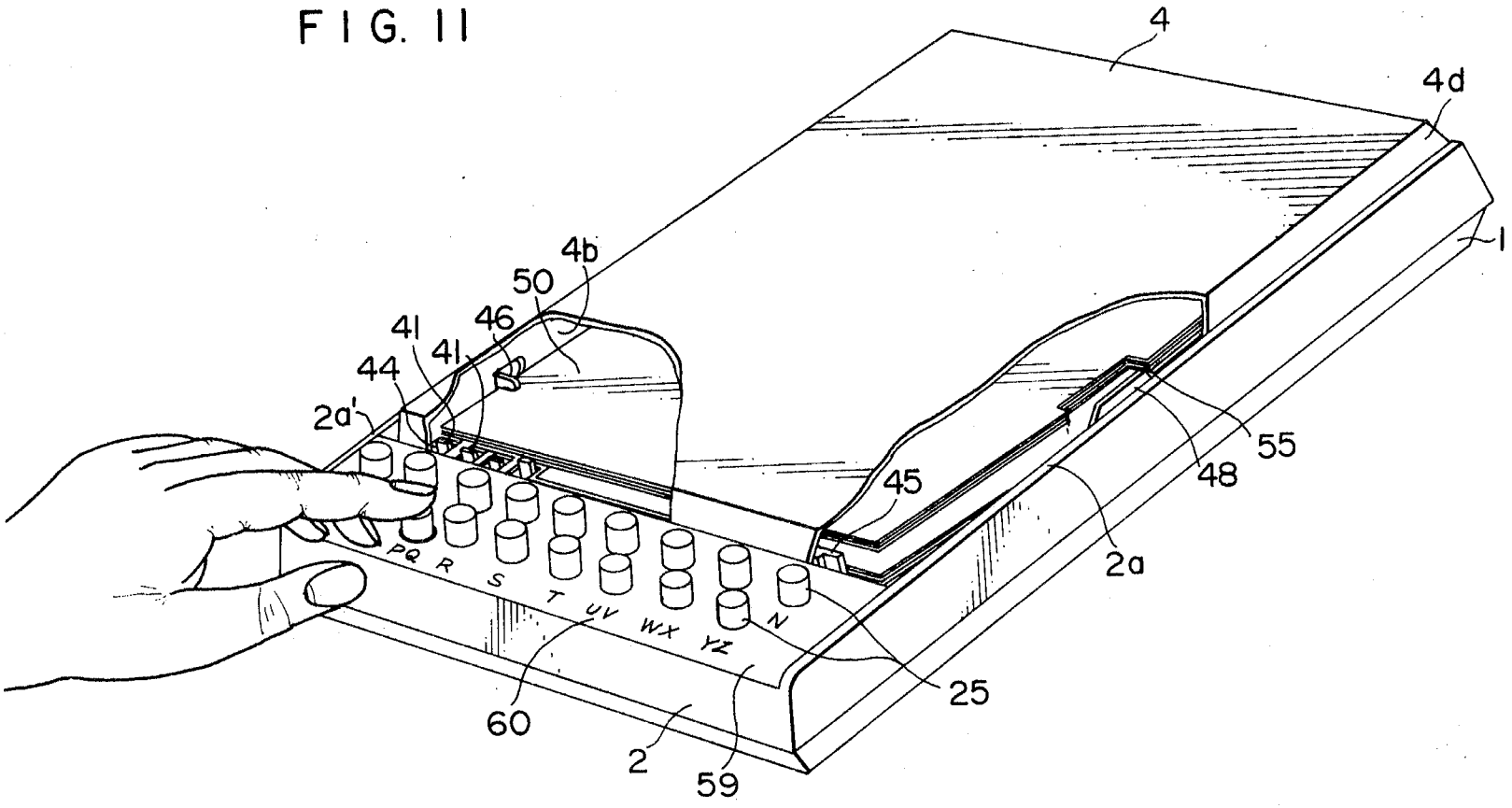
FIG. 11 is an oblique view with portions of the cover cut away, of the indexing device of the present invention with one of the push-buttons pressed.

When in the state of FIG. 11, any one of the push-buttons 25 is pressed to push down the forward end of an operating arm **23*b* of a first lever 23 or the forward end of an operating arm 24*b* of the first lever 24, the first lever 23 turns counterclockwise around the lever shaft 21 thereby causing the middle part of a second lever element 39 of the second lever 35 corresponding to the first lever to be pushed up. The narrow base part 40 of the lever element 39 serves as a hinge to permit element 39 to swing up to the position of FIG. 12*a*, to force the upward projection 41 at the tip of the lever to project through a hole 44 of the card support body 2 to push up the exposed portion of the ear 58 in a wanted card 50, as illustrated in FIG. 12(*a*) and FIG. 13. Therefore, if at the front of the push-buttons 25 on the nameplate 59 codes 60 are given matching the cards 50 to be lifted by the projecting piece 41 when the buttons are pressed, a wanted card 50 can be selectively pushed up by pressing the relevant push-button 25**.

Figure 13:
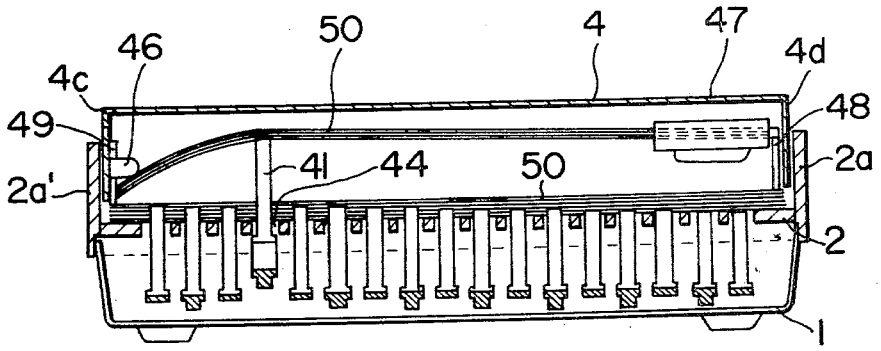
FIG. 13 is a view in section taken along line XII—XII of FIG. 12(*a*), showing how the initially lifted cards are bent by the stop.

When the cards are so lifted, with the cover 4 closed, the top card of the stack is pressed on one side against the boss 46 in the cover 4 and therefore, all the lifted cards including the one pushed up by the projecting piece 41 are lifted on the other side by the projecting piece 41 as the fulcrum, and the cards are bent centering around the portions pushed up by the projecting piece 41. In this position, as indicated in FIG. 13, the forward edge of the other side of the lifted cards is opposed to the hook 54 of the card-grip 47, and the lowermost lifted card is above the tip of hook 54.

With further depression of the button 25 to the position illustrated in FIG. **12(*b*), the bottom edge of operating arm 23*b* or 24*b* of a first lever 23 or 24, hits the top edge of wall 26*e* of the cover latch unit 26 to pivot unit 26 counterclockwise around the lever shaft 21. In consequence the latch arms 30 are displaced leftward to withdraw their hooks 30*a* out of the holes 32 of the cover 4, to release the cover. Then the force of the torsion spring 11 causes the cover 4 to pivot on the bosses 3,3' and begin to open upwardly. Then as the hook 54 of the card-grip 47 disengages from the hook element 45, the hook 54 moves downwardly and inwardly toward the cards by the elasticity of the spring element 53. The so displaced hook 54 then reaches across the right forward edges of the lifted cards and its tip extends under the lower-most lifted card, as shown at FIG. 12(*c*). Hence the pushed-up cards 50 are lifted with the cover 4, to the cover open position shown in FIGS. 14 and 15**.

Movement of the pushed-up cards 50 together with the cover 4 starts with the forming of a gap between the pushed up cards and the cards left on the card support body 2, and the pushed up or initially lifted cards are bent by engagement with stop pin 46 so the lowest lifted card slides slightly on the top unlifted card, and accordingly there is no likelihood that the cards 50 to be left on the card support body 2 are lifted together with the pushed up cards.

When the cover 4 is closed, the latch hooks **30*a* fit into the hole 32 of the cover 4 and the cover 4 is locked to the body 1. As the cover is closed the hook 54 engages the hook engage element 45 and is deflected to the position of FIG. 12(*a*) in which it is beyond the forward edge of the cards 50. The cards 50 which were held by the hook 54 then drop on the card support body 2**, and the index device is ready for next operation.

According to the present invention, there is thus provided an index device in which one end of the cover is pivoted to the rearward end of the body for movement between its open and closed positions, a number of notched cards are stored between the body and the cover, the body is provided with a rod to push up a card at an area adjacent to the notch in the card, while the cover is provided with a projection or boss which bears against one side of the card near the other side of the card and on the cover there is installed a card-grip or holder to pick up the initially lifted cards. Thus the present invention has the following advantages:

(1) The card-push up rod is so arranged that it can be operated by the first lever, one end of which is pushed by the push-button, and the push up rod is at the end of the second lever which adjoins the first lever so the lever action will take place in two steps. This means that the acting point or rod of the second lever can be set close to the push-button array and accordingly the space to house the cards can be enlarged.

(2) Indexing and cover opening can be done by simply pressing a selected push-button and accordingly the operation is quite easy. Because levers 23 and 24 are of different length at each end, the same extent of depression of a push button in the front or back row operates the index device.

(3) The structure is simple and the action is reliable; accordingly the device is trouble-free and easy to manufacture.

(4) Unlike conventional devices, the cards need not be connected or hinged at the rear end; the exposed top card can easily be lifted out; therefore entry of information on the cards by handwriting or typewriting is extremely facilitated. Users can prepare the cards to their own liking and simply exchange them.

(5) In the conventional indexing device, when a wanted card is selected and the cover is opened, the following card or cards are liable to be lifted together with the wanted one. In the device according to the present invention, after a wanted card is first lifted slightly, the lifted cards are held by the cover and are opened together with the cover. As mentioned above, therefore, the following card or cards are prevented from being lifted as the cover opens.

(6) In selecting a card, the card can be reliably pushed up and it can be easily selected.

(7) The mechanism to grip or hold the cards to the cover is small with only a few parts required, and is structurally simple.

(8) Moreover, when the cards are lifted, one side of the cards are supported by the projection of the cover so that the lifting amount of the other side (the card-grip side) of the lifted cards is enlarged in comparison with a construction with no projection on a cover. As a result, there is the advantage that cards are readily lifted to be held by the card-grip while requiring only slight pushing-down of the button.

What is claimed is:

1. An index device comprising (a) a body having a card support;

(b) a cover having a front portion and a rear portion;

(c) means pivotally mounting the rear portion of the cover on a rear portion of the body for pivotal movement between an open position and a closed position with respect to the body;

(d) a stack of cards on said card support and between said body and said cover;

(e) an ear at the tip of each card of said stack, said ears of the respective cards having an essentially constant laterally staggered pitch and being exposed toward the body to form an inverted step-like array when the cards are stacked in the body;

(f) selectively operable means for engaging the ear of a predetermined card to initially push the predetermined card, and cards of the stack between the predetermined card and the cover, toward the cover;

(g) stop means on one side of said cover for engaging the stack to cause the initially pushed cards of the stack to bend so that the pushed predetermined card is effectively separated from the next adjacent card of the unpushed remainder of the stack; and, (h) card holding means on said cover in spaced relation to said stop means for holding the initially pushed cards for movement with the cover to its open position, when the cover is opened.

2. An index device according to claim 1 wherein said card holding means comprises, means responsive to initial opening movement of said cover for causing said card holding means to hold the initially pushed cards for movement with the cover.

3. An index device according to claim 1 wherein said card holding means comprises a spring element with a hook shaped end engageable over an edge of a pushed card, said spring element having a base secured to said cover adjacent its front portion and projecting from said cover at a predetermined angle to engage and hold said initially pushed cards to the cover in response to opening said cover.

4. An index device according to claim 1 wherein said selectively operable means for engaging the ear of a predetermined card comprises a plurality of lever means pivotally mounted to said body; and push-button means for pushing a predetermined lever.

5. An index device according to claim 4 wherein, said lever means comprise, a plurality of constantly spaced first levers pivoted to said body near the forward end of the body; and a plurality of second constantly spaced levers connected to said body at a location remote from the forward end of the body, said second levers having tips moveable to engage the ears of and push said cards.

6. An index device according to claim 5 wherein, each second lever has its tip bent to extend essentially perpendicular to the plane of the body, and each second lever is between said first levers and said body.

7. Index device of claim 6, wherein each second lever comprises an elastic plate.

8. Index device of claim 7, wherein each second lever is flexible at its base, to provide a hinge connection.

9. Index device of claim 8, wherein said second levers comprise a comb-like elastic plate.

10. An index device according to claim 1, wherein said stop means comprises lug means projecting from the cover for binding the initially pushed cards of the stack downwardly along one side of the pushed cards of the stack.

11. An index device comprising:

(a) a body having a card support;

(b) a cover having a front portion and a rear portion;

(c) means pivotally mounting the rear portion of the cover on a rear portion of the body for pivotal movement between an open position and a closed position with respect to the body;

(d) a stack of cards on said card support and between said body and said cover;

(e) an ear at the tip of each card of said stack, said ears of the respective cards having an essentially constant laterally staggered pitch and being exposed toward the body to form an inverted step-like array when the cards are stacked in the body;

(f) selectively operable means for engaging the ear of a predetermined card to initially push the predetermined card, and cards of the stack between the predetermined card and the cover, toward the cover, and comprising:

a plurality of constantly spaced first levers pivoted to said body near the forward end of the body, a plurality of second constantly spaced levers between said first levers and said body, and connected to said body at a location remote from the forward end of the body, each second lever comprising an elastic plate having tips movable to engage the ears of and push said cards, said tips being bent to extend essentially perpendicular to the plane of the body, and push-button means for pushing a predetermined lever;

(g) stop means on one side of said cover for engaging the stack to cause the initially pushed cards of the stack to bend so that the pushed predetermined card is effectively separated from the next adjacent card of the unpushed remainder of the stack; and, (h) card holding means on said cover in spaced relation to said stop means for holding the initially pushed cards for movement with the cover to its open position, when the cover is opened, said card holding means comprising a spring element with a hook shaped end engageable over an edge of a pushed card, said spring element having a base secured to said cover adjacent its front portion and projecting from said cover at a predetermined angle to engage and hold said initially pushed cards to the cover in response to opening said cover.

* * * * *